US010424889B2

(12) United States Patent
Geyer

(10) Patent No.: US 10,424,889 B2
(45) Date of Patent: Sep. 24, 2019

(54) STABILIZED GOLD WIRE BRUSH FOR SLIPRINGS

(71) Applicant: Schleifring GmbH, Fürstenfeldbruck (DE)

(72) Inventor: Robert Geyer, Holzkirchen (DE)

(73) Assignee: SCHLEIFRING GMBH, Fürstenfeldbruck (DE)

( * ) Notice: Subject to any disclaimer, the term of this patent is extended or adjusted under 35 U.S.C. 154(b) by 0 days.

(21) Appl. No.: 16/117,544

(22) Filed: Aug. 30, 2018

(65) Prior Publication Data

US 2019/0074652 A1 Mar. 7, 2019

(30) Foreign Application Priority Data

Sep. 6, 2017 (EP) ..... 17189622

(51) Int. Cl.

| | |
|---|---|
| ***H01R 39/02*** | (2006.01) |
| ***H01R 39/64*** | (2006.01) |
| ***H01R 39/24*** | (2006.01) |
| ***H01R 39/18*** | (2006.01) |
| *H01R 39/46* | (2006.01) |
| *H01R 39/39* | (2006.01) |
| *H01R 39/36* | (2006.01) |

(52) U.S. Cl.

CPC ..... *H01R 39/64* (2013.01); *H01R 39/025* (2013.01); *H01R 39/18* (2013.01); *H01R 39/24* (2013.01); *H01R 39/36* (2013.01); *H01R 39/39* (2013.01); *H01R 39/46* (2013.01)

(58) Field of Classification Search

CPC ..... H01R 39/18; H01R 39/36; H01R 39/39

See application file for complete search history.

(56) References Cited

U.S. PATENT DOCUMENTS

| | | | | |
|---|---|---|---|---|
| 3,959,679 | A | 5/1976 | Buckley | |
| 8,167,623 | B2 * | 5/2012 | Schlichtherle | H01R 39/64 310/232 |
| 9,124,055 | B2 * | 9/2015 | Ott | H01R 39/39 |
| 9,281,648 | B2 * | 3/2016 | Pollner | H01R 39/643 |
| 9,490,600 | B2 * | 11/2016 | Holzapfel | H01R 39/08 |
| 9,882,331 | B2 * | 1/2018 | Winkler | H01R 39/20 |
| 2014/0038435 | A1 | 2/2014 | Hemmí et al. | |

FOREIGN PATENT DOCUMENTS

| | | | | |
|---|---|---|---|---|
| DE | 1130515 B | * | 5/1962 | H01R 39/18 |
| DE | 10215809 | | 11/2003 | |
| DE | 102011077358 | | 12/2012 | |
| EP | 0662736 | | 1/1995 | |
| EP | 1610424 | | 12/2005 | |
| JP | H0993877 | | 4/1997 | |

* cited by examiner

*Primary Examiner* — Tho D Ta

(74) *Attorney, Agent, or Firm* — Yakov S. Sidorin; Quarles & Brady LLP

(57) ABSTRACT

A wire brush for a slipring includes a contact section, from which a stabilizer arm is extending backwards towards the brush block of the slipring. The stabilizer arm holds a friction section, which is in friction contact with the contact section at a friction contact area. Such contact, in operation, generates internal friction within the brush when the brush is moved and, therefore, suppresses oscillations of the brush.

18 Claims, 7 Drawing Sheets

STABILIZED GOLD WIRE BRUSH FOR SLIPRINGS

CROSS-REFERENCE TO RELATED APPLICATIONS

This application claims priority to pending European Application No. 17189622.8 filed on Sep. 6, 2017, the disclosure of which is incorporated by reference herein.

BACKGROUND

1. Field of the Invention

The invention relates to Slip-rings and brushes for Slip-Rings for transmission of electrical signals between rotating parts. Specifically, it relates to a stabilized gold wire brush which attenuates mechanical oscillations.

2. Description of Relevant Art

Electrical slip rings are used to transfer electrical power and/or signals between a rotating and a stationary part. Such devices are used in different applications, like wind energy plants or computer tomography scanners. There are also sever-al military and aerospace applications.

It is common to all of these applications, that a high lifetime and a low contact resistance as well as a low contact noise are required. Furthermore, in specific applications like a CT scanner, centrifuge with speeds exceeding 5 m/s relative speed of brush and module surface, applications with repetitive high accelerations like robots and pick & place machines require specific attention. The same applies for specific environmental requirements like in aerospace applications.

Slip rings are generally based on a first part having sliding tracks and a second part having brushes for sliding on the sliding tracks by a rotational movement. Due to external interference or by changes in friction, interfering movements of the brush other than the rotational movement or oscillations of the brush may occur. Specifically, if the excitation mechanism is based on friction effects, the term frictional induced vibration for these interfering movements is used. Such interfering movements may cause contact noise and/or contact interruptions, adversely affecting signal quality. In applications with an inductive load, electrical arcing may occur during such interruptions, which leads to significant corrosion and wear of the brush and the sliding track. As long as minimum arcing voltage and minimum arcing current e.g. 100 mA and 12 V for gold-gold contacts is exceeded also purely ohmic circuits will be subjected to arcing. At lower values still melting can occur with subsequent damage and wear.

EP 066 27 36 A1 discloses a multi-fiber brush where a strand of multiple thin fibers is used for contacting a sliding track. Due to the internal friction between the individual fibers, oscillations are suppressed. The drawback is the complex design having multiple thin wires held by a ferrule, which is expensive and difficult to manufacture. Furthermore, the fiber bundle has a comparatively large diameter and therefore requires a broad sliding track.

SUMMARY

The embodiments provide mechanical stabilization of a sliding brush of a slip-ring, and preferably a wire brush for a slipring configured such that mechanical oscillations and/or interfering movements of the brush are reduced during the operation of the slipring. The proposed configuration may further lead to a reduction of contact noise, an increase in signal quality, lifetime and reliability of the brush during the operation. The same applies to a slipring comprising the so-configured brush and a sliding track. The solution should be simple and inexpensive and preferably does not require a change in the design of existing brush blocks. Furthermore, the design of proposed embodiment(s) facilitate an automated process of manufacture of such embodiment(s).

In an embodiment, a sliding brush is a wire brush comprising a metal wire. The wire brush includes a contact section configured to contact a sliding track. This contact section has a first end for holding the wire brush and a second end opposing to the first end. The first end may be held by or be attached to a brush block or a brush holder. As known from prior art, such a brush holder provides mechanical fixation of the brush together with an electrical contact to the brush. Preferably, under normal operating conditions, the contact section is in mechanical and electrical (galvanic) contact with a sliding track. A stabilizer arm extends preferably from the second end of the contact section. It preferably extends into a direction towards the first end of the contact section and/or roughly parallel to the contact section. The stabilizer arm holds a friction section which is in frictional contact with the contact section. Such a frictional contact may be established when the friction section is pressed to the contact section. Pressure may be applied sideward or from the top side. The pressing force may be generated by the stabilizer arm. The stabilizer arm may itself have spring characteristics. Preferably, the stabilizer arm is also a wire having a first end which extends from the second end of the contact section. Opposing to the first end of the stabilizer arm, there may be a second end which supports or bears the friction section. Furthermore, the friction section preferably includes a wire material. In an alternative embodiment, the friction section may also be a plate which may increase the frictional contact area between the friction section and the contact section.

In one embodiment, the contact section and the stabilizer arm are made of the same material. It is further preferred, if the contact section and the stabilizer arm are made of one piece. It is further preferred, if the friction section is also made (configured as) a one piece, integral unit with the stabilizer arm (to form a whole unit with the stabilizer arm) and preferably as one piece (integral whole unit) with the contact section. Preferably, the contact section, the stabilizer arm and the friction section are bent with a single, only one piece of wire.

It is preferred, if the stabilizer arm is separate from the contact section. It is further preferred, if there is no contact between the stabilizer arm and the contact section, except at the second end of the contact section which is connected to the stabilizer arm.

Preferably, the friction contact area, the area in which the friction section contacts the contact section, is located between the first end of the contact section and a first point corresponding to the middle of the contact section (and marking half a length of the contact section). Most preferably, it is located between the first end of the contact section and second point corresponding to 30% of the length of the contact section. The friction contact area is preferably between the first end of the contact section and the position where the contact section contacts the sliding track.

Preferably, the friction section includes a surface for generating a predetermined friction, preferably a higher friction. The surface may have a certain roughness or a structure to increase friction. Also, the contact section may have such a surface for generating higher friction, preferably in the contact area.

It is preferred, if the friction section presses or is pressed with a predetermined force against the contact section in the friction contact area.

It is further preferred, of the contact section includes a metal having spring-elastic properties. Such a metal may include at least one of spring steel, brass, bronze, silver, copper, nickel and alloys or combinations thereof. The contact section may also include a carbon material. It may include a piece or wire of carbon material connected to the metal wire or a metal wire coated or plated with a carbon material. The sliding brush may include metal sheet or wire and the contact section may be an attached (soldered, welded, for example) metal contact piece comprising a highly conductive material (brass, in one example), or the attached contact piece may include metal graphite (such as silver-graphite in one example).

It is further preferred, if the contact section has a surface includes a highly conductive material. Such a material may be nickel, silver, gold or any platinoid, a metal chemically resembling platinum, especially osmium, iridium, or palladium. Preferably, the contact section is plated or galvanized providing a thin gold or gold alloy layer.

In another embodiment, the stabilizer arm may be connected by a connecting means to the contact section. Such a connecting means may include at least one of a crimping sleeve, a solder connection, a glued connection, and a welding connection.

In another embodiment, the brush is made of sheet metal. The contact section may have a hole through which the friction section may penetrate (or pass through). The embodiments described herein for a wire brush may also be made with a sheet metal brush. The sheet metal brush may be made from sheet metal comprising at least one of the metals mentioned herein for brushes. The sheet may have a thickness between 0.05 and 3 mm preferably between 0.3 and 1.5 mm. The width may be between 1 and 20 mm, preferably between 3 and 10 mm. The brush may be manufactured by laser cutting, punching and/or bending.

The embodiments work best if there is a significant movement between the friction section at the stabilizer arm and the friction contact area of the contact section, as friction dissipates energy from the mechanical movement of the components. During normal operation, the contact section of the brush is firmly held at the brush block and supported by the sliding track. The second end of the contact section is free and unsupported during normal operation. If there is a certain movement between the sliding track and brush block or if there is a mechanical force to the contact section of the wire brush which may be caused by the stick-slip-phenomenon, the largest movement at the contact section will be at the unsupported second end. Therefore, this unsupported second end is used for transferring this movement via the stabilizer arm to the friction section generating friction with the contact section of the brush. Due to a lever-like design of the stabilizer arm, the amplitude of the movement may even increase at the location of the friction section.

A further embodiment relates to a slipring brush block which includes a brush carrier, holding at least one or preferably a plurality of slipring brushes as mentioned above. Preferably, the brush carrier includes an insulating material and/or electrically conductive material for electrical contact of the sliding brushes.

Another embodiment relates to a slipring assembly includes a sliding track and a slipring brush block as mentioned above. Preferably, at least one or multiple sliding tracks are held by a body of insulating material forming a slipring module.

The embodiments disclosed herein have the advantage, that vibrations and/or oscillations of the brush can be attenuated or reduced significantly. The stabilizer does not weaken the brush, nor does it change the spring properties which results in an unchanged contact force to a sliding track. There are no additional forces from external supports. The linear guidance by a V-groove in a sliding track is not affected, as there are no side forces to the brush. Also, the insulation properties remain unchanged. The new brush is fully compatible to previous brushes and can replace previous brushes without further modification of the slipring system.

BRIEF DESCRIPTION OF THE DRAWINGS

In the following, the invention will be described by way of example, without limitation of the general inventive concept, on examples of embodiment and with reference to the drawings.

Figure 1:
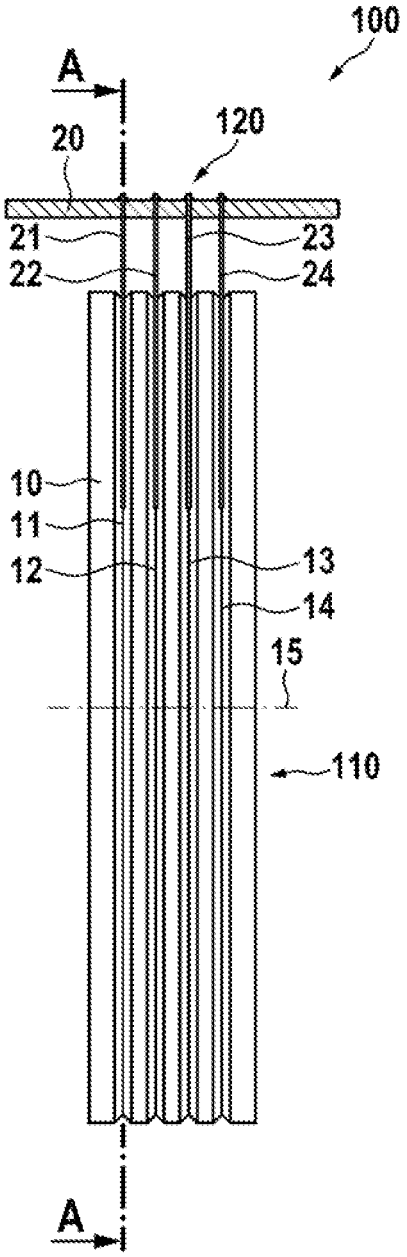
FIG. 1 shows a side view of an embodiment of the invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

In FIG. 1, a side view of a slip-ring assembly 100 is shown. A slip-ring assembly 100 includes a slip-ring module 110 and a slip-ring brush block 120. The slip-ring module 110 is configured to rotate about the rotation axis 15 and preferably includes an insulating body 10, having a plurality of sliding tracks. In side view f FIG. 1, four sliding tracks 11, 12, 13, and 14 are shown, but a different number of sliding tracks can be used in a related embodiment. The sliding tracks are embedded into and/or held by the insulating body. Preferably, the sliding tracks are electrically insulated against each other. There may also be configurations, where at least some of the sliding tracks are connected together electrically. (This latter configuration may be useful for transferring higher currents or signals at a lower noise level.) In this embodiment, sliding tracks are shown to have V-shaped grooves. The V-grooves provide the advantage of accommodating guide wires to sliding within the grooved and keeping the guide wires precisely on a predetermined track during the operation. However, any alternative type of sliding track may be used instead, such as, for example, tracks having multiple grooves or tracks without grooves, for instance those having a plane surface. The slip-ring module 110 is configured to rotate about the rotational axis 15.

The slip-ring brush block 120 includes a brush carrier 20, which may include a printed circuit board or any other insulating material. The brush carrier may also include a conducting material such as a metal, with insulated portions dimensioned to hold the brushes. The brush block 120 preferably holds a plurality of sliding brushes. In this embodiment, four wire brushes 21, 22, 23, and 24 are shown (which have respectively-corresponding brushes on the other side of the insulating body 10). It is appreciated that a different number of brushes and/or different type(s) of brushes could be used in a related embodiment. For example, multi-fiber brushes or carbon brushes can be used. The brushes are spaced with respect to one another such that they fit to corresponding sliding tracks of the slip-ring module 100. There must not necessarily be one brush per sliding track but, instead, there may additionally or in the alternatively be a plurality of brushes contacting a given sliding track to increase current capability and/or reduce noise and/or contact resistance.

Figure 2:
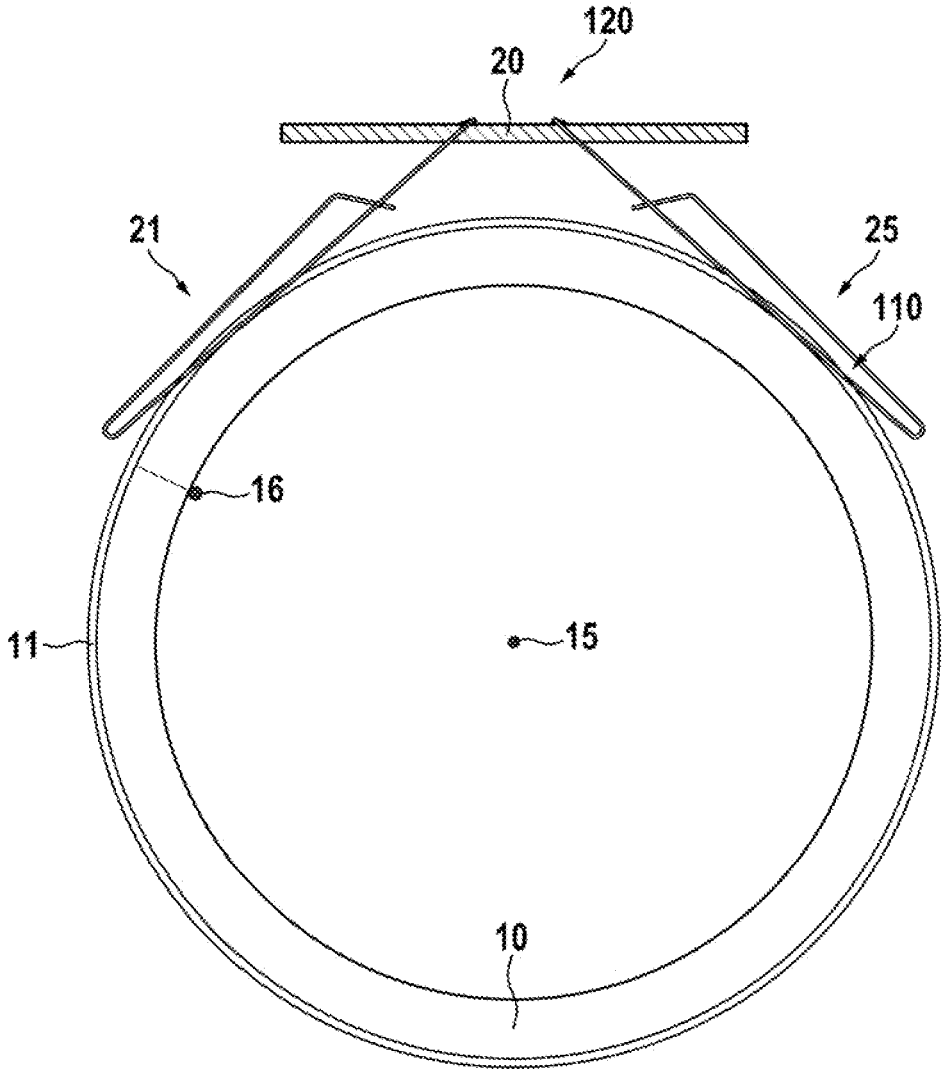
FIG. 2 shows a sectional view of the embodiment of FIG. 1.

In FIG. 2, a sectional view of the first embodiment is shown in a plane cut through lines A-A in FIG. 1. It is preferred, if the slip-ring module have a free bore, for example a bore dimensioned to carry cable(s). A connector 16 is shown, which may be a soldering point or a soldering pin or a soldering connector employed to form electrical contact with the first sliding track 11. In practice, a connecting cable may be soldered to this connector 16. Preferably, the other sliding tracks also have respectively-corresponding connectors formed to contact these sliding tracks from the inner side of the insulating body (such as insulating body 10 as shown). In the embodiment of FIG. 2, the first sliding brush 21 and the fifth sliding brush 25 (corresponding to the first sliding brush 21 and disposed on the other side from the brush 21 with respect to a plane that contains the axis 15 and traverses the carrier 20) are in contact with the first sliding track 11.

Figure 3:
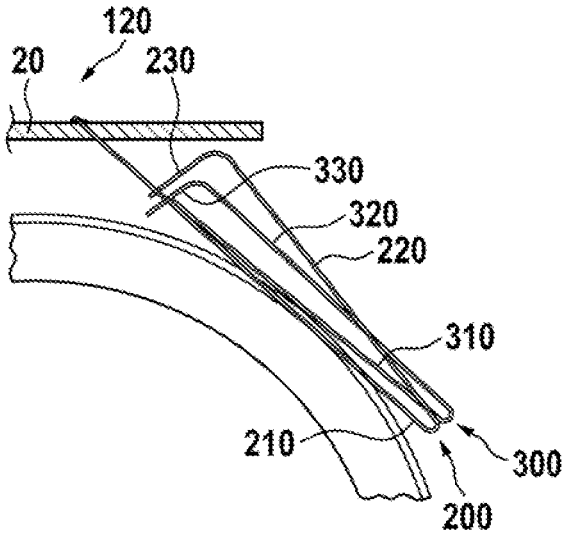
FIG. 3 shows a partial view of the embodiment of FIG. 2.

In FIG. 3, a partial view of the embodiment of FIG. 2 is shown. In FIG. 3, an additional structural detail is indicated—specifically, two different states of the wire brush are indicated. Specifically, the same brush is shown in its normal position (as brush 200) and in its deformed position (as brush 300). First, a wire brush of the embodiment (indicated with a numeral 200 in FIG. 3) is shown in a normal state. The contact section 210, stabilizer arm 220 and friction section 230 of the wire brush 200 are in normal position(s). Both the normal state of the brush and the normal position(s) of the elements of the brush correspond to the situation when the sliding track does not move with respect to the brush. When, for example, a movement of the sliding track or a stick-slip-phenomenon occurs in operation, some force is exerted on the contact section 210, which may lead to minor bending of the contact section 210, as shown. This force and bending further cause an operational deformation of the brush 200, which now, it its deformed state, is shown in the same FIG. 3 as wire brush 300 with a contact section 310. The stabilizer arm 320 of the brush 300 (which represents the deformed in operation brush 200) is now in a position that is closer to the contact section 310 of the brush, and the friction section 330 has moved slightly, as compared to the previous normal position of the friction section. For simplicity of illustration, the degree of movement of the brush between the normal state and the deformed state may be shown exaggerated. The deformation and/or movement of the contact section may happen independently from the cause of the movement or deformation of the contact section. Such a cause may include a movement between the brush block and the sliding track, a stick-slip-phenomenon, and further mechanical forces, for example.

Figure 4:
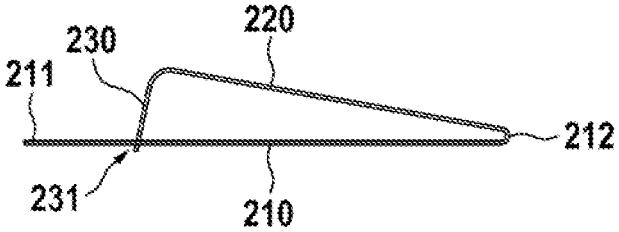
FIG. 4 shows a basic wire brush.

In FIG. 4, a basic wire brush (here, 200) is shown in more detail. The contact section 210 includes a first end 211 by which the brush is usually held, and opposing thereto a second end 212. From the second end 212 extends a stabilizer arm 220. The stabilizer arm 220 holds a friction section 230, which is in friction contact with the contact section 210 in a friction contact area marked 231.

Figure 5:
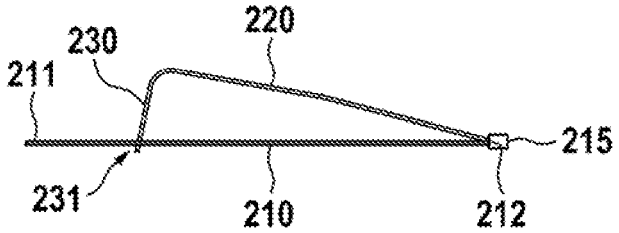
FIG. 5 shows an embodiment with a crimped connection.

In FIG. 5, an embodiment with a crimped connection made by a crimping sleeve 215 between the contact section 210 and the stabilizer arm 220 is shown. This configuration may allow to make the stabilizer arm 220 from a different material having different mechanical and/or electrical characteristics as compared to those of the contact section. For example, the contact section 210 may include a surface layer of a highly conductive material, such as gold or gold alloy. Such materials are comparatively expensive. Sincere it is not operationally required for the stabilizer arm of the brush to have such a conductive surface, the stabilizer arm may be made of simple spring steel or any other suitable material. Alternatively, instead of a crimping connection between the contact section 210 and the stabilizer arm 220, a soldering or welding connection/joint may be used.

Figure 6:
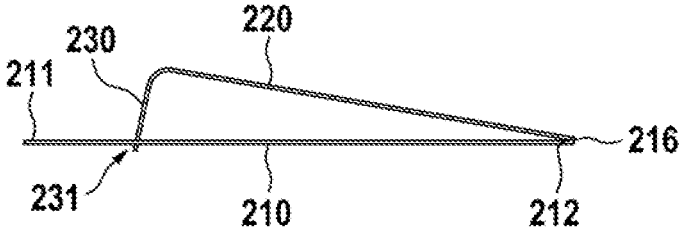
FIG. 6 shows a further embodiment.

In FIG. 6, a further embodiment possessing a sharp bend between the contact section and the stabilizer arm is shown.

Figure 7:
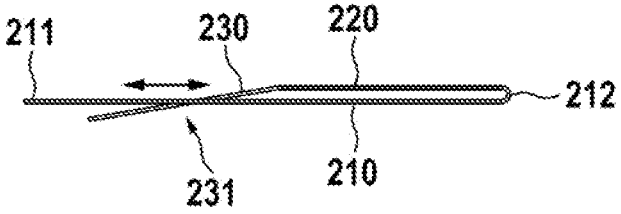
FIG. 7 shows a further embodiment.

In FIG. 7, a related embodiment is shown, where the friction section 230 is configured to intersect and contact the contact section 210 at a comparatively small angle, such that a small movement of the stabilizer arm 220 in a direction away from the contact section results in a comparatively large lateral movement between the friction section and the contact section.

Figure 8:
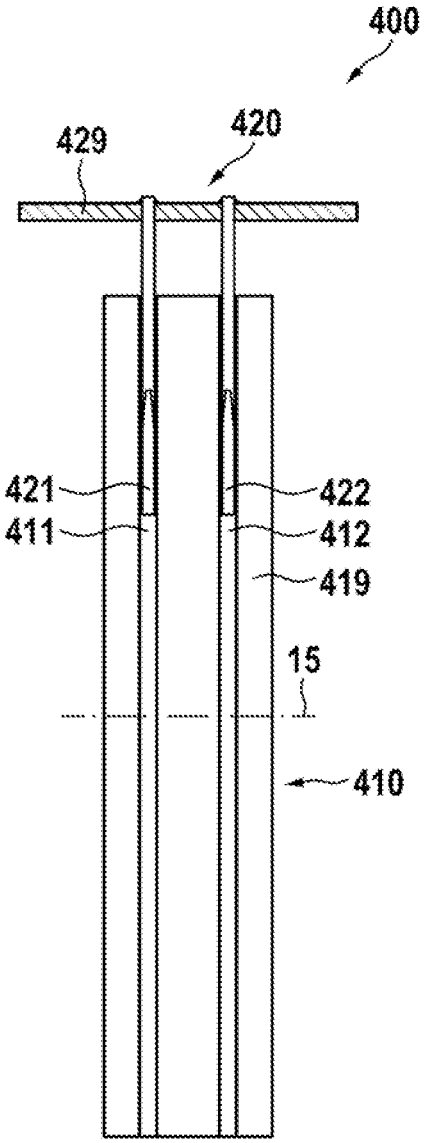
FIG. 8 shows a side view of an embodiment comprising sheet metal brushes.

In FIG. 8, a side view of a slipring assembly having metal sheet brushes is shown. This embodiment is very similar to the embodiment shown in FIG. 1, but has brushes (shown as 421, 422 in this side-view) that are made of metal sheets or strips instead of the wire brushes. A slip-ring assembly 400 includes a slip-ring module 410 and a slip-ring brush block 420. The slip-ring module 410 may rotate, in operation, about the rotation axis 15 and preferably includes an electrically insulating body 410, having a plurality of sliding tracks. Here, two sliding tracks 411 and 412 are shown, but in a related implementation a different number of sliding tracks may be employed. The sliding tracks are embedded and/or held by the insulating body 419. Preferably, the sliding tracks are electrically insulated against each other. Here, a preferred embodiment of sliding tracks having a planar shape (rectangular cross-section) is shown. In contrast to the wire brushes mentioned above, the sheet metal brushes require no side stabilization or guidance and, therefore, may run on planar tracks that are easier to manufacture. Alternatively, differently-shaped sliding track(s) may be used instead.

The slip-ring brush block 400 includes a brush carrier 420, which may include a printed circuit board or any other insulating material. It may also include a conducting material such as metal, portion of which are electrically insulated for holding the brushes. The brush block 400 preferably holds a plurality of sliding brushes. In this embodiment, two wire brushes 421, 422 are shown, but a different number of brushes and/or different types of brushes may be employed. The brushes are spaced such that they fit to corresponding sliding tracks 411, 412 of the slip-ring module. There must not necessarily be one brush per sliding track, but additionally or in the alternative there may be a plurality of brushes contacting a given sliding track to increase current capability and/or reduce noise and/or contact resistance.

Figure 9:
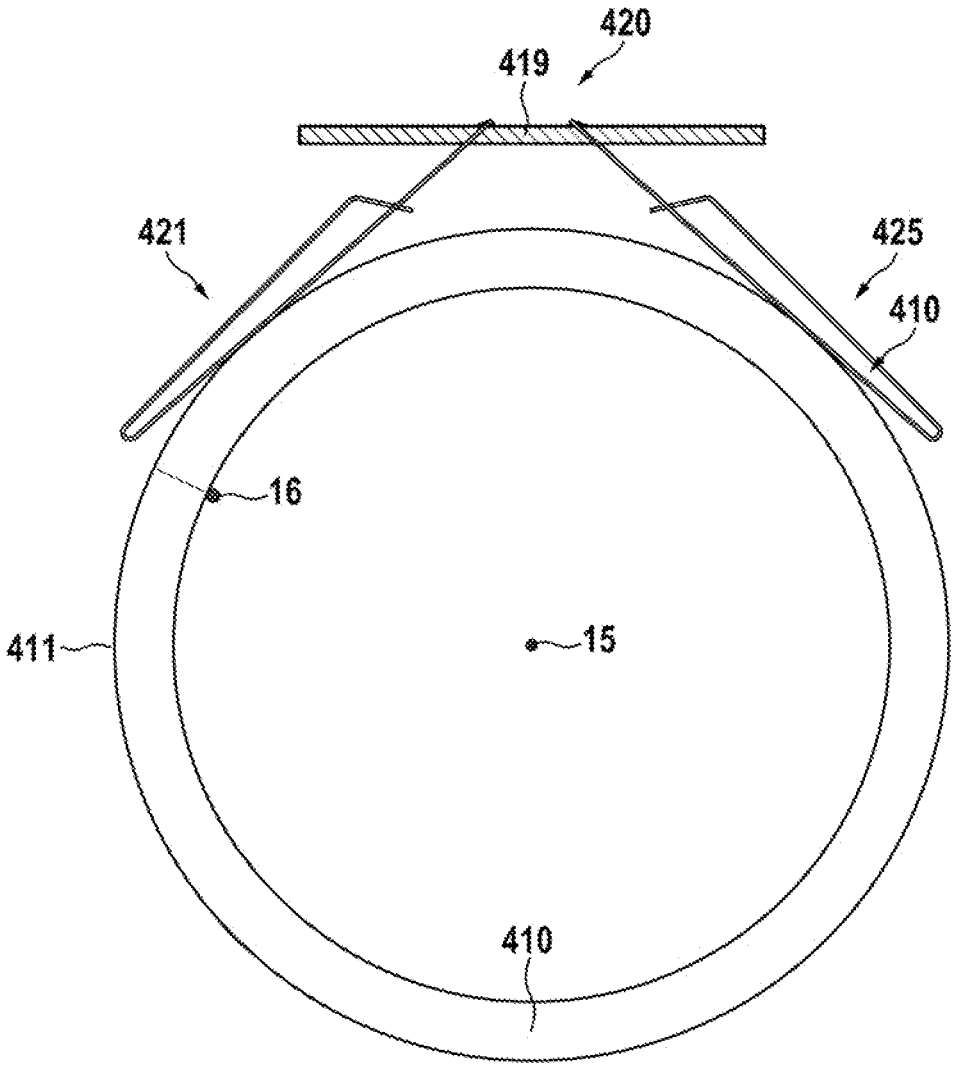
FIG. 9 shows a sectional view of the previous embodiment.

In FIG. 9, a sectional view of the embodiment 400 is shown in a plane cut through the center of the sliding track on the left in FIG. 8 (a plane that is perpendicular to the rotation axis 15). It is preferred, if the slip-ring module have a free bore, for example a bore dimensioned to carry cable(s). In the view of FIG. 9, a connector 16 is shown, which may be configured as a soldering point or a soldering pin or a soldering connector, which electrically contacts the first sliding track 411. A connecting cable may be soldered to this connector. Preferably, the other sliding tracks also have corresponding connectors to contact the sliding tracks from the inner side of the insulating body 410. In this embodiment, the first sliding brush 421 and the third sliding brush 425 (corresponding to the brush 421 and disposed on the other side of the track with respect to the plane that contains the axis 15 and that traverses the block 42) contact the same first sliding track 411.

Figure 10:
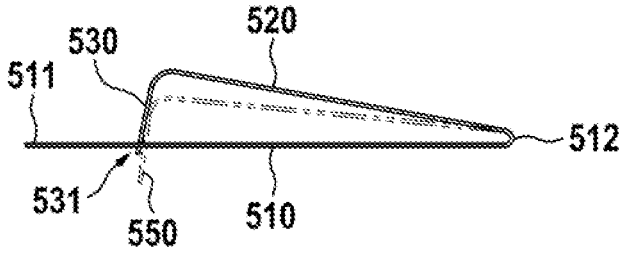
FIG. 10 shows a first sheet metal brush in a side view.

In FIG. 10, a basic sheet metal brush is shown in more detail. The contact section 510 of such brush includes a first end 511 (by which the brush is usually held) and opposing thereto a second end 512. From the second end 512 extends a stabilizer arm 520. The stabilizer arm is configured to hold a friction section 530 (which is in friction contact with the contact section 510 in a friction contact area marked 531). To establish such friction contact, a hole 540 may be provided in the body of the brush between the first end 511 and the second end 512 (as shown further in FIG. 11), through which hole the friction section 530 penetrates/passes through while forming a friction contact with at least one wall of the hole 540. The hole preferably has a rectangular or squared shape. Most preferably, friction is generated at that side of the hole 540 that is oriented towards the second end 512 or the side that is oriented towards the first end 511. A deformed (in operation) stabilizer arm and the corresponding movement of the friction section are shown with dashed lines as 550. Such deformation may occur, when for example the second end 512 is bent upwards (not shown).

Figure 11:
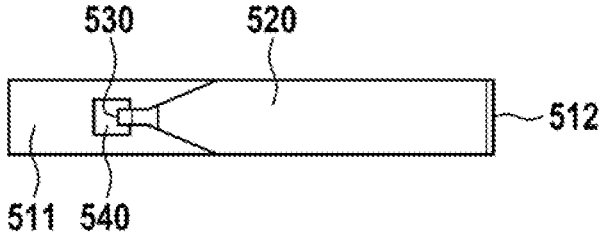
FIG. 11 shows a first sheet metal brush in a top view.

FIG. 11 shows the embodiment of FIG. 10 in a top view. As shown, in this embodiment the friction section 530 is narrower than the stabilizer arm 520 to fit into and through the hole 540.

Figure 12:
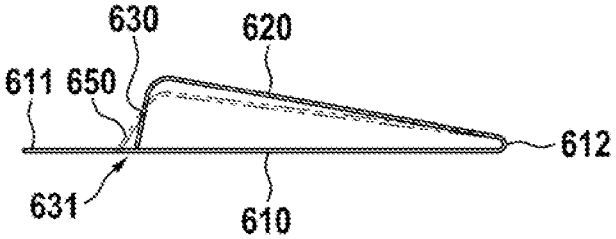
FIG. 12 shows a second sheet metal brush in a side view.

FIG. 12 shows an embodiment similar to that of FIG. 11, but without the hole 540. Instead, the end of the friction section 630 of the stabilizer arm 620 is arranged in contact with the top of the contact section 610 between the first end 611 and the second end 612, in contact area 631. A deformed stabilizer arm and the corresponding movement of the friction section are shown in dashed lines as 650. Such deformation may occur, when for example the second end 512 is bent upwards (not shown).

Figure 13:
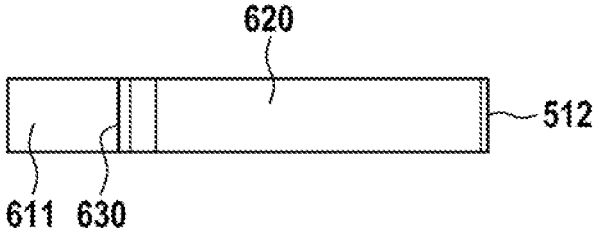
FIG. 13 shows a second sheet metal brush in a top view.

FIG. 13 shows the embodiment of FIG. 12 in a top view. In this embodiment, the friction section 630 has the same width as the stabilizer arm 620 (but it may also be narrower if so modified).

It will be appreciated to those skilled in the art having the benefit of this disclosure that this invention is believed to provide brushes for sliprings and sliprings. Further modifications and alternative embodiments of various aspects of the invention will be apparent to those skilled in the art. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

10 insulating body
11 first sliding track
12 second sliding track
13 third sliding track
14 fourth sliding track
15 rotation axis
16 connector
20 brush carrier
21 first sliding brush
22 second sliding brush
23 third sliding brush
24 fourth sliding brush
25 fifth sliding brush
100 slip-ring assembly
110 slip-ring module
120 slip-ring brush block
200 wire brush
210 contact section
211 first end of contact section
212 second end of contact section
215 crimping sleeve
216 bend
220 stabilizer arm
230 friction section
231 friction contact area
300 wire brush
310 contact section
320 stabilizer arm
330 friction section
400 slip-ring assembly
410 slip-ring module
411 first sliding track
412 second sliding track
419 insulating body
420 slip-ring brush block
429 brush carrier
421 first sliding brush
422 second sliding brush
425 third sliding brush
510 contact section
511 first end of contact section
512 second end of contact section
520 stabilizer arm
530 friction section
531 friction contact area
540 hole
610 contact section
611 first end of contact section
612 second end of contact section

620 stabilizer arm
630 friction section
631 friction contact area

The invention claimed is:

1. A sliding brush for a slipring, the sliding brush comprising:

a contact section that includes a metal wire or a metal sheet and that has a first end dimensioned to be held in a brush carrier of the slipring, and a second end opposite to the first end, a stabilizer arm having third and fourth ends, and a friction section, wherein the stabilizer arm is extending from the second end towards the first end, the third and second ends being affixed to one another, the fourth end being a free disconnected end of the stabilizer arm, the stabilizer arm further holding the friction section, the friction section being in friction contact with the contact section at a single friction contact area, the single friction contact area located at the fourth end.

2. The sliding brush according to claim 1, wherein the friction contact area is located between the first end and a point at half a length of the contact section.

3. The sliding brush according to claim 1, wherein the friction contact area is located between the first end and 30% of the length of the contact section.

4. The sliding brush according to claim 1, wherein at least one of the friction section and the contact section in the friction contact area includes surfaces configured to generate predetermined friction.

5. The sliding brush according to claim 1, wherein the friction section is configured to press with a predetermined force against the contact section in the friction contact area.

6. The sliding brush according to claim 1, wherein the contact section includes metal having spring elastic properties.

7. The sliding brush according to claim 6, wherein the contact section includes spring steel or brass.

8. The sliding brush according to claim 1, wherein the contact section has a surface comprising a highly conductive material.

9. The sliding brush according to claim 1, wherein at least one of the stabilizer arm and the friction section includes the same material as that of the contact section.

10. The sliding brush according to claim 1, wherein at least one of the stabilizer arm and the friction section form a one-piece unit with the contact section, wherein said metal wire or metal sheet is bent upon itself to extend towards the first end.

11. The sliding brush according to claim 1, wherein the stabilizer arm is connected to the contact section by a connecting means including one of a crimping sleeve, a solder connection, a glued connection, and a welding connection.

12. The sliding brush according to claim 1, wherein the sliding brush comprises the metal sheet and the contact section has a hole through which the friction section penetrates.

13. The sliding brush according to claim 1, wherein the sliding brush comprises the metal sheet, and the contact section is an attached metal contact piece comprising at least one of a highly conductive material and metal graphite.

14. A slip-ring brush block comprising a brush carrier holding a plurality of sliding brushes, each brush configured according to claim 1.

15. A slip-ring assembly comprising a slip-ring module and further comprising at least one sliding track and a slip-ring brush block according to claim 14.

16. The slip ring assembly according to claim 14, wherein the friction contact area is located between the first end and a location, at the contact section, where the contact section of the sliding brush contacts the sliding track, the sliding brush including a wire brush.

17. A sliding brush for a slipring, the sliding brush comprising:

a contact section that includes a metal wire or a metal sheet and that has:

a first end dimensioned to be held in a brush carrier of the slipring and a second end opposite to the first end;

a stabilizer arm; and a friction section;

wherein the stabilizer arm is extending from the second end, the stabilizer arm further holding the friction section, the friction section being in friction contact with the contact section at a friction contact area; and wherein the sliding brush comprises the metal sheet and the contact section has a hole through which the friction section penetrates.

18. A sliding brush for a slipring, the sliding brush comprising:

a contact section that includes a metal wire or a metal sheet and that has:

a first end dimensioned to be held in a brush carrier of the slipring and a second end opposite to the first end;

a stabilizer arm; and a friction section;

wherein the stabilizer arm is extending from the second end, the stabilizer arm further holding the friction section, the friction section being in friction contact with the contact section at a friction contact area; and wherein the friction contact area is located between the first end and a location, at the contact section, where the contact section of the sliding brush contacts the sliding track, the sliding brush including a wire brush or a metal sheet brush.

* * * * *